United States Patent [19]

Neyret

[11] 4,101,262

[45] Jul. 18, 1978

[54] PRESSURE REGULATOR FOR GAS LIGHTER

[75] Inventor: Guy Neyret, Francheville, France

[73] Assignee: Société Anonyme dite: Etablissements GENOUD & CIE, Venissieux, France

[21] Appl. No.: 692,729

[22] Filed: Jun. 4, 1976

[30] Foreign Application Priority Data

Jun. 5, 1975 [FR] France ..... 75 18161

[51] Int. Cl.[2] ..... F23D 13/04

[52] U.S. Cl. ..... 431/344; 137/550

[58] Field of Search ..... 431/344, 130, 131, 142, 431/143, 150, 254, 277, 276; 137/550

[56] References Cited

U.S. PATENT DOCUMENTS

| | | | |
|---|---|---|---|
| 2,573,424 | 10/1951 | Flamm | 431/344 |
| 2,737,037 | 3/1956 | Zellweger | 431/344 |
| 2,804,763 | 9/1957 | Russell et al. | 431/344 |
| 3,174,310 | 3/1965 | Genoud | 431/344 |
| 3,542,247 | 11/1970 | Racket | 431/344 |
| 3,590,591 | 7/1971 | Genound | 431/344 |
| 3,663,152 | 5/1972 | Yoshida | 431/150 |
| 3,860,385 | 1/1975 | Nakanishi | 431/344 |

*Primary Examiner*—Edward G. Favors
*Assistant Examiner*—R. J. Charvat
*Attorney, Agent, or Firm*—Karl F. Ross

[57] ABSTRACT

A pressure regulator for a gas lighter which comprises, in a well of the lighter body, a porous membrane of constant natural porosity separating two chambers from one another to set the maximum flame height. A downstream chamber is connected to the burner outlet and serves for evaporation while upstream of the filter the wetting chamber communicates with the reservoir containing the fuel.

15 Claims, 3 Drawing Figures

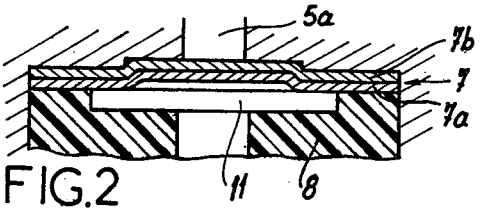
FIG.2
FIG.1
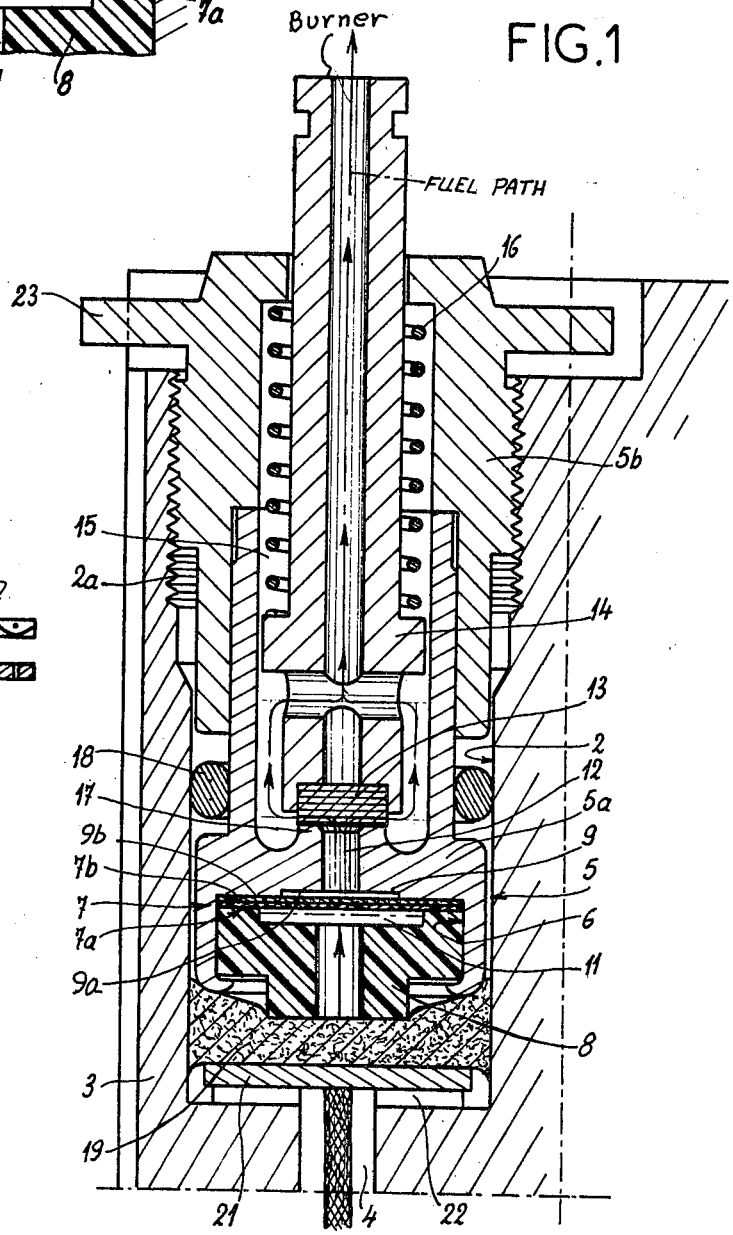
FIG.3
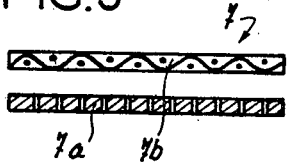

PRESSURE REGULATOR FOR GAS LIGHTER

FIELD OF THE INVENTION

The present invention relates to a pressure-regulator for gas lighters.

BACKGROUND OF THE INVENTION

Whether or not they are provided with means for regulation by the user, lighters are always provided with at least one pressure-regulating filter which limits the height of the flame to a value less than the maximum height considered tolerable in accordance with safety requirements. This pressure-regulating filter is made from a porous material such as fibers or foam and means are provided for regulating the compression of this filter depending on the desired maximum rate of flow, during assembly of the pressure regulator. These means are constituted either by (threaded) members which become inaccessible after assembly of the lighter, or by abutments or the like limiting the travel of tools for assembling and/or fitting the parts constituting the pressure regulator, or by abutments limiting the movement of the key for regulating the lighter.

OBJECT OF THE INVENTION

The present invention intends to simplify the construction and assembly of these pressure regulators and consequently to reduce the cost price thereof.

SUMMARY OF THE INVENTION

To this end, the pressure regulator to which it relates comprises, at least one filter constituted by a porous membrane having good wettability with regard to hydrocarbons, held between two chambers, an upstream wetting chamber and a downstream evaporation chamber and whose porosity characteristics correspond to the maximum desired rate of flow depending on the desired height of flame.

Materials which are quite suitable for forming this filter are polyolefins of molecular structure and in particular polypropylene or polyethylene.

When the valve is opened, the pressure which prevails upstream of the membrane tends to deform the latter and press it against the wall of the base of the evaporation chamber.

In order to prevent this deformation from resulting in a reduction of the useful surface of the membrane to a value corresponding to the section of the gas outlet channel, according to another feature of the invention, there is associated with the membrane at least one fibrous layer placed on its downstream side.

Preferably, in order to prevent any consequences of inserting the membrane in the wrong direction, two fibrous layers are provided, each of which is fixed to one of the sides of the membrane.

Each fibrous layer is advantageously fixed by sticking or welding to said face of the membrane.

According to a practical embodiment of the invention, the filter is housed in a cavity provided to receive it in the lower end of the valve body and in the base of which the evaporation chamber is provided and it is fitted in this cavity with the interposition of a support member in which a wetting chamber for the filter is provided, adjacent the membrane.

Advantageously, the valve body is made from a material which is a good heat conductor, in order to facilitate the transfer of heat from the burner-valve member to the evaporation chamber whereas the support washer for the membrane is made from a material which is a non conductor or poor conductor of heat in order to prevent the evaporation of the liquefied gas upstream of the membrane.

In the case where it is desired to provide adjustment of the height of the flame by the user, there is provided in the base of the hole serving as a housing for the valve and pressure regulator, a filter of conventional type, i.e., of fibrous material or foam, against which the base of the valve body bears directly, the latter being mounted by screwing it into the hole which serves as a housing for the latter and its upper end being provided with an actuating wheel, the porosity characteristics of the porous membrane thus corresponding to the maximum flame height.

Preferably, in this case, the wetting chamber has a large cross section, improving the wetting conditions of the membrane and a slight depth keeping its volume at the smallest possible value, in order to prevent the accumulation of too great a quantity of liquefied gas between the filter and the membrane, when the valve is closed. At the time of lighting, one thus eliminates the initial formation of a large flame which immediately decreases to the value predetermined by the adjustment made to the filter by the user.

BRIEF DESCRIPTION OF THE DRAWING

The invention will be better understood by means of the ensuing description, referring to the accompanying diagrammatic drawing, in which:

FIG. 1 is an axial cross sectional view which illustrates a valve for a gas lighter provided with a pressure regulator according to the invention as a non-limiting example, FIG. 2 is a detail view of the membrane assembly in use; and FIG. 3 is an exploded view thereof.

SPECIFIC DESCRIPTION

The valve is housed in a hole or well 2 provided to receive the latter in the body 3 of the lighter and connected to the reservoir by a channel 4.

Provided at the lower end of the valve body 5 is a cavity 6 intended to receive the pressure regulator according to the invention.

As shown in the drawing, this pressure regulator comprises a filter 7 pressed against the base of the cavity 6 by a support member 8 in turn fitted in said cavity.

Provided in the base of the cavity 6 is a cylindrical chamber 9 located downstream of the filter 7 and constituting an evaporation chamber and provided in the side of the member 8 bearing against the filter 7 is another cylindrical chamber 11 of larger diameter than the chamber 9 located upstream of the filter 7 and intended to facilitate wetting of the latter by the liquefied gas.

According to the invention, the filter 7 is constituted by a porous membrane **7*a* having good wettability with regard to hydrocarbons, associated with the upper side of which is a fibrous and thus also porous layer 7*b***.

The porosity of the porous membrane **7*a*** is chosen in order to obtain a maximum rate of flow of gas corresponding to a flame height for current use.

Materials which are perfectly suitable for forming this filter are polyolefins of molecular structure and in particular polypropylene and polyethylene.

The presence of the fibrous layer **7*b***, which is advantageously fixed by sticking or welding to the corresponding side of the membrane 7*a*, has the effect of providing a passage for the gas, even when, under the effect of the pressure prevailing upstream of the filter 7, the latter is pressed against the base of the evaporation chamber 9 (see FIG. 2). In fact, without the presence of the layer 7*b*, the effect of the deformation of the membrane 7*a* would be that only its part located in the region of the channel 12 would be used.

As can be seen from FIG. 1, the valve body formed with the chamber 9 has an axially open recess 9*a* and a shoulder surrounding the recess against which the membrane 7*a* and its fibrous covering 7*b* is retained.

This channel 12 is normally kept closed by a valve body 13 supported by a valve member 14 mounted in a cylindrical housing 15 in the valve body 5 and constantly acting on which is the spring 16 intended to keep it in the closed position. This spring could be outside the valve.

A valve seat 17 is provided in the base of the cyclindrical housing 15 at the outlet of the channel 12.

An annular gasket 18 ensures a seal between the valve body 5 and the hole 2 serving as a housing for the latter.

The advantage of using a porous membrane 7*a* as the pressure regulator in a valve of a gas lighter is that it requires no regulation when it is assembled, since the rate of flow corresponding thereto depends solely on the pressure prevailing in the lighter reservoir and on its porosity characteristics. It also makes it possible to eliminate devices for limting the flame height, which are outside the valve.

To facilitate the assembly of this lighter valve, the membrane 7*a* is preferably fixed by sticking or welding to the support member 8. To prevent any assembly errors, it is clearly possible to cover the two sides of the membrane 7*a* with a porous layer 7*b*, as shown in dot-dash line in the drawing.

As in numerous currently known lighters, the burner is provided at the upper free end of the valve 14. According to another feature of the invention, in order to ensure a good transfer of heat between the burner and the evaporation chamber 9 for liquefied gas, with a view to promoting this evaporation, the valve body is made from a material which is a good heat conductor and in particular of metal.

On the other hand, according to another feature of the invention, so that there is no danger of causing evaporation of the liquefied gas in the wetting chamber 11, the support member 8 is made from a material which is a non-conductor or poor conductor of heat, such as plastic (synthetic-resin) material.

For the purpose of facilitating the manufacture of this valve, while providing a support region for the spring 16 of the valve 14, the valve body 5 is made in two coaxial cylindrical parts and is force-fitted, namely a lower part 5*a* and an upper part 5*b*.

In the drawings, and although this is not indispensable in the framework of the present invention, a valve facilitating adjustment of the flame height by the user, has been shown. For this reason, apart from the pressure regulator 7, there is provided in the base of the hole 2, below the valve 5, a filter 19 of traditional type, i.e., of fibrous material or foam, pressed by the valve body 5 against a support washer 21, below which are provided radial passages 22 for the liquefied gas coming from the channel 4.

Furthermore, the upper part 5*b* of the valve body 5, is firstly mounted by screwing in the hole 2, whose upper end is provided with a screwthread 2*a* and secondly, is provided with a ring 23 serving as a drive wheel.

By acting on this wheel 23, the user may thus compress the filter 19 to a greater or lesser extent and reduce the gas flow to a greater or lesser extent.

In this case, the function of the pressure regulator 7 is to limit the maximum height of the flame to a value less than or equal to a safe value. Thus, even if the user completely decompresses the filter 8, the flame will never exceed the height corresponding to the rate of flow determined by the characteristics of the membrane 7*a* of the pressure regulator 7.

It will be noted that the dimensions of the wetting chamber 11 located downstream of the filter 19 are of very reduced volume, which eliminates the accumulation of too great a quantity of liquefied gas downstream of the filter 19 and consequently, upon opening the valve 14, the formation of a large flame whose height corresponds to the rate of flow of the membrane 7*a* independent of the adjustment previously made by the user, by compressing the filter 19. At the time of ignition, one thus eliminates the annoyance of obtaining a large flame whose height decreases immediately to the value corresponding to the regulation of compression of the filter 19. The fuel flow path is shown in dot-dash lines.

Naturally, and as is apparent from the aforesaid, the invention is not limited to the single embodiment of this valve provided with a pressure regulator, which was described above as a non-limiting example. On the contrary, it includes all variations.

I claim:

1. A pressure regulator for a gas lighter containing a reservoir of a gasifiable liquid fuel, said pressure regulator comprising a porous membrane of constant natural porosity and good wettability for hydrocarbons constituting a filter for controlling the maximum flame height of said lighter, means defining on one side of said filter a wetting chamber communicating with said reservoir, means defining on the other side of said filter an evaporation chamber communicating with a burner outlet, said filter having porosity characteristics determined at the time of its manufacture to establish a maximum height for said flame, at least one fiber layer disposed along a side of said membrane, and means independent of said membrane and compressible to vary the flame height.

2. A pressure regulator for a gas lighter containing a reservoir of a gasifiable liquid fuel, said pressure regulator comprising a porous membrane of constant natural porosity and good wettability for hydrocarbons constituting a filter for controlling the maximum flame height of said lighter, means defining on one side of said filter a wetting chamber communicating with said reservoir, means defining on the other side of said filter an evaporation chamber communicating with a burner outlet, said filter having porosity characteristics determined at the time of its manufacture to establish a maximum height for said flame, at least one fiber layer disposed along a side of said membrane, said membrane being composed of a material selected from the group which consists of polyethylene and polypropylene.

3. The pressure regulator defined in claim 1 wherein said fiber layer is disposed between said porous membrane and said evaporation chamber.

4. A pressure regulator for a gas lighter containing a reservoir of a gasifiable liquid fuel, said pressure regulator comprising a porous membrane of constant natural porosity and good wettability for hydrocarbons constituting a filter for controlling the maximum flame height of said lighter, means defining on one side of said filter a wetting chamber communicating with said reservoir, means defining on the other side of said filter an evaporation chamber communicating with a burner outlet, said filter having porosity characteristics determined at the time of its manufacture to establish a maximum height for said flame, at least one fiber layer disposed along a side of said membrane, said fiber layer being disposed between said porous membrane and said evaporation chamber, another fiber layer being disposed on the opposite side of said membrane.

5. A pressure regulator for a gas lighter containing a reservoir of a gasifiable liquid fuel, said pressure regulator comprising a porous membrane of constant natural porosity and good wettability for hydrocarbons constituting a filter for controlling the maximum flame height of said lighter, means defining on one side of said filter a wetting chamber communicating with said reservoir, means defining on the other side of said filter an evaporation chamber communicating with a burner outlet, said filter having porosity characteristics determined at the time of its manufacture to establish a maximum height for said flame, at least one fiber layer disposed along a side of said membrane, said fiber layer being disposed between said porous membrane and said evaporation chamber, said fiber layer being bonded to said membrane.

6. The pressure regulator defined in claim 1 wherein said means forming said evaporation chamber includes a valve member having an axially open recess, a shoulder surrounding said recess, and a passage communicating with said burner outlet, said membrane being retained against said shoulder, and wherein said means forming said wetting chamber includes a support member received in said valve member and bearing against said membrane, said support member communicating with said reservoir.

7. The pressure regulator defined in claim 6 wherein said valve member is composed of a material of relatively high thermal conductivity and said support member is composed of a material of relatively low thermal conductivity.

8. A pressure regulator for a gas lighter containing a reservoir of a gasifiable liquid fuel, said pressure regulator comprising a porous membrane of constant natural porosity and good wettability for hydrocarbons constituting a filter for controlling the maximum flame height of said lighter, means defining on one side of said filter a wetting chamber communicating with said reservoir, means defining on the other side of said filter an evaporation chamber communicating with a burner outlet, said filter having porosity characteristics determined at the time of its manufacture to establish a maximum height for said flame, at least one fiber layer disposed along a side of said membrane, said means forming said wetting chamber including a support member received in said valve member and bearing against said membrane, said support member communicating with said reservoir, said lighter comprising a housing formed with a well, said valve member being threaded into said well, said well having a bottom, said pressure regulator further comprising a further filter permeable to said fuel and adjustably compressible to vary the height of said flame, said further filter being received betweeen said support body and the bottom of said well.

9. The pressure regulator defined in claim 8 wherein said wetting chamber has a diameter substantially greater than its depth.

10. A valve system for a lighter comprising:

a lighter body formed with a well having a bottom and provided with a passage, and a reservoir for a gasifiable liquid fuel communicating with said passage;

a valve member threaded adjustably into said well and provided at its end turned toward said bottom with a compartment and at its end turned away from said bottom with a cavity, and between said compartment and said cavity a valve seat;

a burner-carrying tube received in said cavity and displaceable therein towards and away from said seat;

a valve body carried by said tube for engagement with said seat for selectively blocking and unblocking flow of fuel through said tube;

a porous membrane filter of good wettability to hydrocarbons and constant natural porosity received in said chamber for establishing a maximum flame height for said lighter;

a support member received in said compartment and bearing against said filter; and a further filter compressible to vary the flow rate of fuel therethrough disposed between said support member and said bottom of said well.

11. The valve system defined in claim 1 wherein said support member is composed of a material of low thermal conductivity and said valve member and said tube are composed of material of high thermal conductivity.

12. The valve system defined in claim 10 wherein said valve member is formed with a bore communicating with said seat, an annular shoulder in said compartment surrounding said bore, and a recess inwardly of said shoulder and open to said bottom forming an evaporation chamber which is closed by said porous membrane filter.

13. The valve system defined in claim 10 wherein said support member is formed with a recess open toward said filter and forming a wetting chamber, said recess having a large diameter and a small depth.

14. The valve system defined in claim 10, further comprising a fiber layer lying along one side of said porous membrane filter and retained between said porous membrane filter and one of said members.

15. A valve system for a lighter comprising:

a lighter body formed with a well having a bottom and provided with a passage, and a reservoir for a gasifiable liquid fuel communicating with said passage;

a valve member threaded adjustably into said well and provided at its end turned toward said bottom with a compartment and at its end turned away from said bottom with a cavity, and between said compartment and said cavity a valve seat;

a burner-carrying tube received in said cavity and displaceable therein towards and away from said seat;

a valve body carried by said tube for engagement with said seat for selectively blocking and unblocking flow of fuel through said tube;

a porous membrane filter of good wettability to hydrocarbons and constant natural porosity received in said chamber for establishing a maximum flame height for said lighter;

a support member received in said compartment and bearing against said filter;

a further filter compressible to vary the flow rate of fuel therethrough disposed between said support member and said bottom of said well;

a fiber layer lying along one side of said porous membrane filter and retained between said porous membrane filter and one of said members; and another fiber layer disposed between the opposite side of said porous membrane filter and the other said members.

* * * * *